US008439653B2

(12) United States Patent
Nathan et al.

(10) Patent No.: US 8,439,653 B2
(45) Date of Patent: May 14, 2013

(54) PUMP FOR A HIGH-PRESSURE CLEANING APPARATUS

(75) Inventors: Robert Nathan, Backnang (DE); Juergen Erdmann, Schorndorf-Weiler (DE); Sven Dirnberger, Steinheim (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 13/425,477

(22) Filed: Mar. 21, 2012

(65) Prior Publication Data

US 2012/0216890 A1 Aug. 30, 2012

Related U.S. Application Data

(63) Continuation of application No. PCT/EP2010/064156, filed on Sep. 24, 2010.

(30) Foreign Application Priority Data

Oct. 1, 2009 (DE) ..... 10 2009 049 096

(51) Int. Cl.
*F04B 49/24* (2006.01)

(52) U.S. Cl.
USPC ..... 417/300; 417/270

(58) Field of Classification Search ..... 417/270, 417/300
See application file for complete search history.

(56) References Cited

U.S. PATENT DOCUMENTS

| | | | | |
|---|---|---|---|---|
| 2,018,119 | A * | 10/1935 | Brouse | 417/282 |
| 2,562,615 | A * | 7/1951 | Huber | 417/289 |
| 2,806,430 | A * | 9/1957 | Osborne | 137/115.07 |
| 3,362,335 | A | 1/1968 | Stephens et al. | |
| 4,692,102 | A | 9/1987 | Häfele et al. | |
| 4,784,368 | A * | 11/1988 | Koch et al. | 251/51 |
| 5,259,556 | A | 11/1993 | Paige et al. | |
| 5,397,054 | A * | 3/1995 | Ziegs | 239/126 |
| 5,409,032 | A | 4/1995 | Berfield | |
| 5,735,461 | A * | 4/1998 | Winther | 239/124 |
| 5,950,669 | A | 9/1999 | Fehlmann et al. | |
| 6,474,958 | B2 * | 11/2002 | Nathan | 417/269 |
| 6,497,247 | B1 | 12/2002 | Kinoshita et al. | |
| 6,866,483 | B2 * | 3/2005 | Pol | 417/43 |
| 2007/0267063 | A1 | 11/2007 | Davis | |
| 2010/0059603 | A1 | 3/2010 | Mueller et al. | |

FOREIGN PATENT DOCUMENTS

| | | |
|---|---|---|
| CN | 2694014 | 4/2005 |
| DE | 27 05 585 | 8/1977 |
| DE | 32 48 622 | 7/1984 |

(Continued)

*Primary Examiner* — Charles Freay

(74) *Attorney, Agent, or Firm* — Lipsitz & McAllister, LLC

(57) ABSTRACT

A pump for a high-pressure cleaning apparatus for delivering cleaning liquid is provided. The pump has at least one pump chamber into which at least one reciprocally movable piston plunges. The pump chamber is connected via at least one inlet valve to a suction conduit and via at least one outlet valve to a pressure conduit. A bypass conduit leads from the pressure conduit to the suction conduit. A bypass valve is arranged in the bypass conduit. The valve body of the bypass valve is connected to a control member which displaces the valve body to a closed or an open position and displaces a switch plunger which is coupled to the valve body to a first or a second switch position. The valve body opens a passage upstream of the valve seat which becomes wider when the valve body is at a predetermined distance from the valve seat.

12 Claims, 7 Drawing Sheets

FOREIGN PATENT DOCUMENTS

| | | |
|---|---|---|
| DE | 85 14 497 | 8/1985 |
| DE | 36 34 827 | 4/1988 |
| DE | 39 36 155 | 5/1991 |
| DE | 42 21 286 | 1/1993 |
| DE | 93 01 796 | 5/1993 |
| DE | 43 28 382 | 3/1994 |
| DE | 44 45 519 | 6/1996 |
| DE | 296 11 935 | 10/1996 |
| DE | 297 03 009 | 6/1997 |
| DE | 196 07 881 | 9/1997 |
| DE | 196 17 778 | 10/1997 |
| DE | 297 12 659 | 10/1997 |
| DE | 197 28 225 | 1/1999 |
| DE | 696 02 551 | 9/1999 |
| DE | 10 2007 017 970 | 10/2008 |
| DE | 10 2008 059 782 | 6/2009 |
| EP | 0 608 796 | 8/1994 |
| EP | 0 631 054 | 12/1994 |
| EP | 0 668 113 | 8/1995 |
| EP | 44 04 925 | 8/1995 |
| EP | 0 793 017 | 9/1997 |
| EP | 1 234 980 | 8/2002 |
| EP | 1 496 252 | 1/2005 |
| FR | 2 341 087 | 9/1977 |
| JP | 2006207833 | 8/2006 |

* cited by examiner

PUMP FOR A HIGH-PRESSURE CLEANING APPARATUS

This application is a continuation of international application number PCT/EP2010/064156 filed on Sep. 24, 2010 and claims the benefit of German application No. 10 2009 049 096.5 filed on Oct. 1, 2009.

The present disclosure relates to the subject matter disclosed in international application number PCT/EP2010/064156 of Sep. 24, 2010 and German application No. 10 2009 049 096.5 of Oct. 1, 2009, which are incorporated herein by reference in their entirety and for all purposes.

BACKGROUND OF THE INVENTION

The invention relates to a pump for a high-pressure cleaning apparatus for delivering a cleaning liquid, said pump comprising at least one pump chamber into which at least one reciprocally movable piston plunges and which is connected via at least one inlet valve to a suction conduit and is connected via at least one outlet valve to a pressure conduit, and a bypass conduit leading from the pressure conduit to the suction conduit and having arranged therein a bypass valve, the valve body of which is connected, via a piston rod, to a control member which displaces the valve body as a function of the flow rate of the cleaning liquid in the pressure conduit to a closed position or an open position and displaces a switch plunger which is coupled to the valve body to a first or a second switch position to actuate a switch element.

Pumps of this type are known from DE 196 07 881 A1. They can be used to pressurize and then direct a cleaning liquid, for example water, towards an object, using for example a pressure hose which can be connected to the pressure conduit, and a nozzle head which is arranged at the free end of the pressure hose. In order for the mechanical loading of the pump as well as heat losses to be reduced, the cleaning liquid pumped by the pump when the nozzle head is closed is recirculated against as low a resistance to flow as possible, i.e. it is recycled from the pressure conduit back to the suction conduit so that the pressure in the pressure conduit can be reduced. For this purpose, the pressure conduit is connected to the suction conduit via a bypass conduit, said bypass conduit having a bypass valve arranged therein. In working mode of the pump, i.e. when the nozzle head is open, the bypass valve closes the flow communication between the pressure conduit and the suction conduit. If the nozzle head is closed, the bypass valve opens the flow communication between the pressure conduit and the suction conduit, thereby reducing the pressure existing in the pressure conduit. For this purpose, the valve body of the bypass valve is connected via a piston rod to a control member that displaces the valve body as a function of the flow rate of the cleaning liquid in the pressure conduit to a closed position or an open position. The flow rate of the cleaning liquid in the pressure conduit is a function of whether the nozzle head is open or closed. If the nozzle head is closed, the flow rate decreases, thus causing the control member to displace the valve body of the bypass valve to its open position so as to allow the cleaning liquid under pressure to flow to the suction conduit against as low a resistance to flow as possible. If the nozzle head is opened, the flow rate in the pressure conduit increases, thus causing the control member to displace the valve body of the bypass valve to the closed position so that the pump transitions to normal working mode.

In addition to its function of controlling the bypass valve, the control member provides the function of displacing a switch plunger that is coupled to the valve body. The switch plunger can actuate a switch element. The switch element may, for example, turn on and off a drive device of the pump, preferably an electric motor. Actuating the switch plunger thus allows the pump to be activated and deactivated. If the flow of liquid in the pressure conduit is stopped, then on the one hand the bypass valve opens the flow communication between the pressure conduit and the suction conduit so that the pressure existing in the pressure conduit can be reduced, and on the other hand the switch plunger is displaced to a first switch position so that the switch element turns off the pump. However, for the switch plunger to reach said switch position, it has to overcome a certain travel distance. To this end, the valve body should, where practicable, be acted upon by as great a differential pressure as possible in order to assist the movement of the switch plunger coupled thereto. However, as a result of such a differential pressure, the cleaning liquid in the bypass conduit suffers significant losses of flow. This leads to heat losses in and to considerable mechanical load on the pump. Provided that it is ensured that, after the flow communication between the pressure conduit and the suction conduit has been opened, the pump is reliably switched off, short-term loading of the pump in recirculation mode can be tolerated. However, should the pump fail to be turned off, due for instance to a defect in the switch element, then the pump's continued running in recirculation mode at a persistently high differential pressure at the valve body of the bypass valve may result in damage thereto.

Therefore, it is an object of the present invention to improve a pump of the type mentioned at the outset such that, when the pump transitions to recirculation mode, the switch plunger reliably overcomes a certain travel distance to actuate the switch element, while the cleaning liquid suffers as low losses of flow as possible when the pump remains in recirculation mode for extended periods of time.

SUMMARY OF THE INVENTION

In accordance with the invention, this object is achieved in a pump of the generic type in that the valve body, as it transitions from its closed position to its open position, opens a passage upstream of the valve seat permitting cleaning liquid to flow therethrough, the flow cross-section of said passage becoming wider when the valve body is at a predetermined distance from the valve seat.

In the case of the pump in accordance with the invention, if the flow of liquid in the pressure conduit is stopped, the valve body of the bypass valve transitions from its closed position to its open position, wherein it unseats from the valve seat and opens a passage through which the cleaning liquid can flow. The flow cross-section of the passage becomes wider when the valve body is at a predetermined distance from the valve seat. This makes it possible for the flow cross-section of the passage to be initially kept very small when the valve body unseats from the valve seat, so that a considerable pressure drop occurs at the valve body and the cleaning liquid from the pressure conduit can only very gradually flow to the suction conduit. As a result of this, the switch plunger is initially displaced through a certain travel distance until the valve body is at a predetermined distance from the valve seat. The flow cross-section of the passage opened by the valve body then becomes wider, so that thereafter the cleaning liquid suffers only relatively low pressure losses in the area of the bypass valve. The switch plunger can therefore be reliably displaced to its first switch position, in which it can actuate the switch element to turn off the pump, and only after that is the cleaning liquid conducted, against as low a resistance to flow as possible, from the pressure conduit through the bypass conduit to the suction conduit. Should the switch element be defective or be mounted incorrectly on the pump and therefore, although actuated by the switch plunger, fail to turn off the pump, the cleaning liquid is recirculated with relatively low losses of flow in the subsequently continued recirculation mode operation of the pump. The thermal loading and also the mechanical loading of the pump in sustained recirculation mode operation can therefore be kept low. On the other hand, however, it is ensured that, when the valve body unseats from the valve seat, the switch plunger always initially overcomes a predetermined travel distance. This travel distance corresponds to the predetermined distance of the valve body from the valve seat at which the flow cross-section of the passage in the bypass valve which permits cleaning liquid to flow therethrough increases.

Therefore, the pump in accordance with the invention is distinguished on the one hand in that, when the flow of liquid in the pressure conduit is stopped, the switch plunger reliably overcomes a predetermined travel distance so that the switch element can be properly actuated. On the other hand, the pump in accordance with the invention is distinguished in that, when it remains in recirculation mode for extended periods of time, which may for example occur if the switch element is defective, the cleaning liquid is permitted to flow from the pressure conduit to the suction conduit with low losses of flow and, therefore, the pump is subject to low thermal and pressure loading when it runs in the continued recirculation mode.

Preferably, the passage permitting cleaning liquid to flow therethrough when the valve body of the bypass valve unseats from the valve seat has a first constant flow cross-section along a first partial distance of the stroke movement of the valve body. In the transition from its closed position to its open position, the valve body performs a stroke movement. The flow cross-section of the passage opened by the valve body preferably remains unchanged along a first portion of the stroke movement. This ensures that despite the gradual transition of the valve body from the closed position to the open position, only a constant amount of cleaning liquid per unit time can initially flow through the bypass valve, so that after the flow of liquid in the pressure conduit has been stopped, the pressure in the pressure conduit can drop only very gradually, although the valve body of the bypass valve is at an increasing distance from the valve seat. The pressure drop, which initially takes place only slowly, ensures that the valve body is displaced further by the control member in the direction of its open position, and, with it, also the switch plunger coupled to the valve body is displaced further in the direction of its first switch position. It is only when this switch position has been reached, i.e. when the valve body is at a predetermined distance from the valve seat, that the flow cross-section of the passage opened by the valve body becomes wider, now permitting a larger amount of cleaning liquid per unit time to flow through the passage, thus allowing the pressure in the pressure conduit to decrease faster.

In an advantageous embodiment, the passage has a second constant flow cross-section along a second partial distance of the stroke movement of the valve body following the first partial distance, said second flow cross-section being larger than the first flow cross-section. After the valve body has overcome the first partial distance of its stroke movement, it opens a larger flow cross-section for the passage permitting cleaning liquid to flow therethrough. The increased flow cross-section then remains unchanged while overcoming the second partial distance of the stroke movement of the valve body. Thus, while the flow cross-section of the passage becomes wider once the valve body has reached a predetermined distance from the valve seat, the increased flow cross-section then undergoes no further change along the second partial distance of the stroke movement of the valve body.

It is advantageous for the valve body to be configured as a radial extension of the piston rod, wherein the piston rod extends through a valve housing of the bypass valve and the valve housing forms a valve seat, wherein the diameter of the piston rod is constricted upstream of the valve body at a predetermined distance therefrom. Configuring the valve body as a radial extension of the piston rod makes it particularly cost-effective to produce. The change in the flow cross-section of the passage which permits cleaning liquid to flow therethrough when the valve body unseats from the valve seat can advantageously be achieved by varying the diameter of the piston rod. The piston rod can have a constriction at a predetermined distance from the valve body upstream of same. The constriction ensures that the flow cross-section of the passage opened by the valve body increases at the predetermined distance.

By way of example, provision may be made for the piston rod to have a first cylindrical section of constant diameter following the valve body in an upstream direction. As the valve body transitions from its closed position, in which it contacts the valve seat of the valve housing, to its open position, in which it is at a distance from the valve seat, the first cylindrical section of the piston rod following the valve body in an upstream direction initially defines, in combination with the valve housing through which the piston rod extends, the flow cross-section of the passage which permits cleaning liquid to flow therethrough. This flow cross-section can be kept relatively small by the diameter of the first cylindrical section being only a little smaller than the diameter of the opening of the valve housing through which the piston rod extends. An annular gap is then formed between the opening of the valve housing and the first cylindrical section, the width of said annular gap being determined by the diameter of the opening and the diameter of the cylindrical section.

Preferably, the diameter of the first cylindrical section is at least 90%, in particular approximately 95%, of the diameter of the valve opening.

It is advantageous for the piston rod to have a second cylindrical section of constant diameter in a direction upstream of the first cylindrical section, wherein the diameter of the second cylindrical section is smaller than the diameter of the first cylindrical section. When the valve body unseats from the valve seat, first the first cylindrical section of the piston rod assumes a position within the opening of the valve housing through which the piston rod extends and thus defines a first annular gap, which can be very narrow in size. During the further movement of the valve body in the direction of its open position, the second cylindrical section of the piston rod then reaches a position within the opening of the valve housing. With the second cylindrical section having a smaller diameter than the first cylindrical section, it defines a larger annular gap, i.e. the passage in the valve housing that is opened by the valve body comprises a larger flow cross-section, permitting the flow of cleaning liquid through the bypass valve with lower losses of flow.

Preferably, the diameter of the second cylindrical section is at most 80%, in particular approximately 75%, of the diameter of the valve opening.

In a preferred embodiment of the invention, the switch plunger coupled to the valve body is configured as an axial extension of the piston rod through which the valve body is connected to the control member. In such an embodiment of the invention, the piston rod projects beyond the valve body on the side thereof that faces away from the control member and in this projecting area forms the switch plunger.

The free end of the switch plunger can extend into a receiving space of the pump, said receiving space having the switch element arranged therein.

The piston rod is preferably oriented parallel to the pressure conduit.

In a preferred embodiment of the invention, the pump has a rear housing part and a front housing part, which are tightly joined together in a joining area, and a suction conduit section extends in the joining area between the two housing parts, and the bypass conduit opens out into the suction conduit section. The rear housing part faces towards a drive device of the pump, such as an electric motor, wherein a gear and/or a swash plate as well as a piston guide can be arranged between the electric motor and the rear housing part. The front housing part is mounted on the rear housing part and faces away from the drive device of the pump. In accordance with this advantageous embodiment of the invention, a suction conduit section into which the bypass conduit opens out is arranged in the joining area between the two housing parts, i.e. in the area where the two housing parts tightly abut one another. The suction conduit section can be produced in a simple and cost-effective manner before the two housing parts are joined together. This allows the manufacturing cost of the pump to be reduced. Furthermore, by arranging the suction conduit section in the joining area between the two housing parts, the bypass conduit can be selected to be very short. This is advantageous in that the flow losses of the cleaning liquid in the bypass conduit can be kept low. The suction conduit section arranged between the two housing parts can have a relatively large flow cross-section. This allows the flow losses of the cleaning liquid to be reduced further when the pump runs in recirculation mode.

The arrangement of the suction conduit section in the joining area between the front and the rear housing part is further advantageous in that the geometric course of the suction conduit section is subject to reduced boundary conditions because the joining area is directly accessible for machining and shaping operations before the two housing parts are joined together. It is therefore also possible, if required, to select a curved course for the suction conduit section arranged between the two housing parts without a substantial increase in the cost of manufacture being incurred. This, in turn, makes it possible for the designer to optimize the arrangement of the remaining conduits and receiving spaces of the pump to make it as minimal in overall size and material usage as possible. In particular, the course of the bypass conduit can be optimized such that it offers as low a resistance to flow as possible.

The sealing of the suction conduit section extending between the two housing parts can be realized in a cost-effective manner by seal rings which are arranged between the two housing parts.

In particular, provision may be made for the suction conduit section arranged between the two housing parts to extend between a first seal ring and a second seal ring which are positioned between the two housing parts. The two seal rings may not only serve the function of tightly sealing the suction conduit section arranged between the two housing parts but may also provide the additional function of sealing the joining area between the two housing parts.

It is advantageous for the suction conduit section extending between the two housing parts to form an outlet section of the suction conduit. The outlet section may be followed by at least one inlet conduit which accommodates an inlet valve and leads to a pump chamber. By way of the suction conduit section arranged in the joining area between the two housing parts, the bypass conduit is thus connected to at least one inlet conduit which leads to a pump chamber. This allows the flow losses of the cleaning liquid to be reduced further when the pump is running in recirculation mode.

It is advantageous for the suction conduit to comprise an inlet section arranged in the front housing part, and the suction conduit section extending in the joining area between the two housing parts forms an outlet section of the suction conduit. The inlet section may extend from a suction connection of the pump and be oriented, for example, in a direction transverse to the pressure conduit. The inlet section may be followed directly by the outlet section arranged between the two housing parts.

Preferably, the suction conduit section extending in the joining area has an arcuate curvature in at least a section thereof. The arcuate curvature is advantageous in particular in view of the pump's space constraints because it provides a way for the suction conduit section to surround receiving spaces for the inlet and outlet valves and for the control member and, if necessary, also the pressure conduit. A circular arc shaped course has proven to be particularly advantageous for the suction conduit section arranged in the joining area.

In a particularly advantageous embodiment of the pump in accordance with the invention, the suction conduit section extending in the joining area is configured as a self-contained ring. In such an embodiment, an annular space can extend in the joining area between the rear housing part and the front housing part, said annular space forming the above-mentioned suction conduit section. The annular space can have a relatively large flow cross-section, so that the cleaning liquid to be pumped can be supplied to the at least one pump chamber against a low resistance to flow. In particular when the pump is running in recirculation mode, the cleaning liquid can be recirculated with low losses of flow starting from the pump chamber, passing through the pressure conduit, the bypass conduit and the suction conduit, and back to the pump chamber.

The front housing part of the pump has a rear-end parting surface which is mounted on a front-end parting surface of the rear housing part with at least one seal element interposed therebetween. Preferably, at least one of the parting surfaces has a channel integrally formed therein, said channel forming at least a part of the suction conduit section arranged in the joining area between the two housing parts. The channel is arranged on an outer side of at least one of the housing parts and is therefore very cost-effective to produce.

It is advantageous for the rear-end parting surface of the front housing part to have integrally formed therein a channel which is covered by the front-end parting surface of the rear housing part and forms the suction conduit section arranged in the joining area between the two housing parts.

Alternatively, by way of example, provision may be made for the front-end parting surface of the rear housing part to have integrally formed therein a channel which is covered by the rear-end parting surface of the front housing part and forms the suction conduit section.

In an advantageous embodiment of the invention, the suction conduit section extending in the joining area between the two housing parts extends around the pressure conduit in spaced relation thereto. In particular, provision may be made for the suction conduit section extending in the joining area to surround the pressure conduit in a ring shape.

In an advantageous embodiment of the invention, the control member is configured as a control piston which divides a control chamber of the front housing part into a low-pressure chamber and a high-pressure chamber, is displaceable in the control chamber, and is connected to the valve body of the bypass valve via the piston rod, wherein the low-pressure chamber is connected to the pressure conduit via a control conduit downstream of a restriction and the high-pressure chamber is connected to the pressure conduit via a section of the bypass conduit arranged upstream of the bypass valve. In such an embodiment, the pressure conduit of the pump has a restriction arranged therein, which may be, for example, an injector with which a cleaning chemical can be drawn in and admixed to the cleaning liquid under pressure. In the presence of a flow of liquid in the pressure conduit, the restriction results in the pressure downstream of the restriction varying from the pressure upstream of the restriction. Since the low-pressure chamber communicates with the pressure conduit via the control conduit downstream of the restriction whereas the high-pressure chamber communicates with the pressure conduit via a first section of the bypass conduit upstream of the restriction, a differential pressure is applied to the control piston in the presence of a flow of liquid through the pressure conduit. Owing to the differential pressure acting on it, the control piston, via the piston rod, displaces the valve body of the bypass valve counter to the direction of flow existing in the bypass conduit to a closed position in which the valve body contacts the valve seat of the bypass valve. If the flow of liquid is interrupted, then the restriction does not cause a pressure drop, and the pressure in the low-pressure chamber corresponds to the pressure in the high-pressure chamber. In the absence of a differential pressure between the two chambers, the control piston can be acted upon by a resultant force which is a function of the areas exposed to pressure of the two chambers and which displaces the control piston in the control chamber such that the valve body connected therewith via the piston rod transitions to an open position, i.e. a position at a distance from the valve seat, thereby opening the flow communication between the pressure conduit and the suction conduit for the pump to run in recirculation mode.

The movement of the control piston is transferred via the piston rod to the valve body. Preferably, the control piston is displaceable parallel to the pressure conduit and the piston rod is oriented parallel to the pressure conduit.

In a preferred embodiment of the invention, the switch plunger extends into a receiving space which is integrally formed in the rear housing part and in which the switch element is arranged. The switch plunger thus extends through the joining area between the two housing parts.

It is particularly advantageous for the bypass conduit to include a section accommodating the bypass valve, said section opening out into the suction conduit section extending in the joining area between the two housing parts, and being aligned with the control chamber. Said section of the bypass conduit can follow the control chamber directly and, owing to the positioning of the suction conduit section in the joining area between the two housing parts, the section accommodating the bypass valve can be selected to be very short.

It is advantageous for the control chamber and the section of the bypass conduit accommodating the bypass valve to be oriented parallel to the pressure conduit.

In an advantageous embodiment of the pump in accordance with the invention, the control chamber and the section of the bypass conduit accommodating the bypass valve are arranged in a through-channel which extends through the front housing part from an end face to a rear-end parting surface. This simplifies manufacture of the pump, thereby reducing the cost of manufacture. Furthermore, the provision of the through-channel provides for simplified assembly of the pump because both the bypass valve and the control piston can be inserted into the through-channel in an axial direction.

The following description of a preferred embodiment of the invention serves to explain the invention in greater detail in conjunction with the drawings.

DETAILED DESCRIPTION OF THE INVENTION

Figure 3:
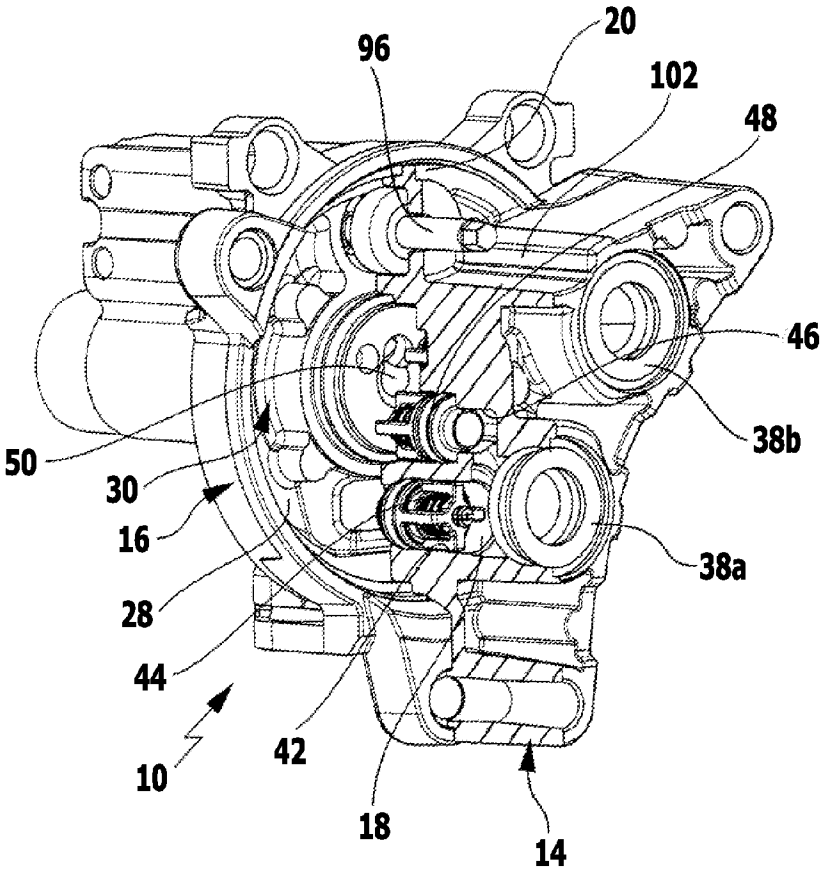
FIG. 3 is a perspective view, taken at an angle from the rear, of the pump shown in FIG. 1, with the rear housing part partly cut away.

The drawing is a schematic view of a pump 10 for a high-pressure cleaning apparatus. The pump 10 comprises a pump housing 12 including a rear housing part 14 and a front housing part 16. The two housing parts are preferably configured in the form of aluminium pressure die castings. The front housing part 16 is provided with a rear-end parting surface 20 which is mounted on a front-end parting surface 22 of the rear housing part 14 with an outer seal ring 24 and an inner seal ring 26 interposed therebetween. The two seal rings 24 and 26 are arranged concentrically with one another at the outer and inner edge, respectively, of an annular channel 28 integrally formed in the rear-end parting surface 20 of the front housing part 16. The annular channel 28 is shown in FIG. 3 in particular. It forms an outlet section 30 of a suction conduit whose inlet section 32 in the form of a blind hole is integrally formed in the front housing part 16.

The rear housing part 14 accommodates pump chambers 34, each with corresponding cylindrical pistons 36*a* and 36*b* extending thereinto. The pistons 36*a*, 36*b* are sealed against their respective pump chamber 34 by a lip-shaped ring seal 38*a* and 38*b*, respectively. The rear housing part 14 has three pump chambers in total, into each of which extends a piston. For clarity of illustration, only one pump chamber 34 and two pistons 36*a* and 36*b* are shown in the drawing. All the pistons are inserted into their respective pump chamber 34 with an oscillatory motion by a swash plate known per se, not shown in the drawing, and are retracted from the pump chamber by a coil spring 40 that surrounds the respective piston, whereby the volume of the pump chambers 34 changes periodically.

Figure 2:
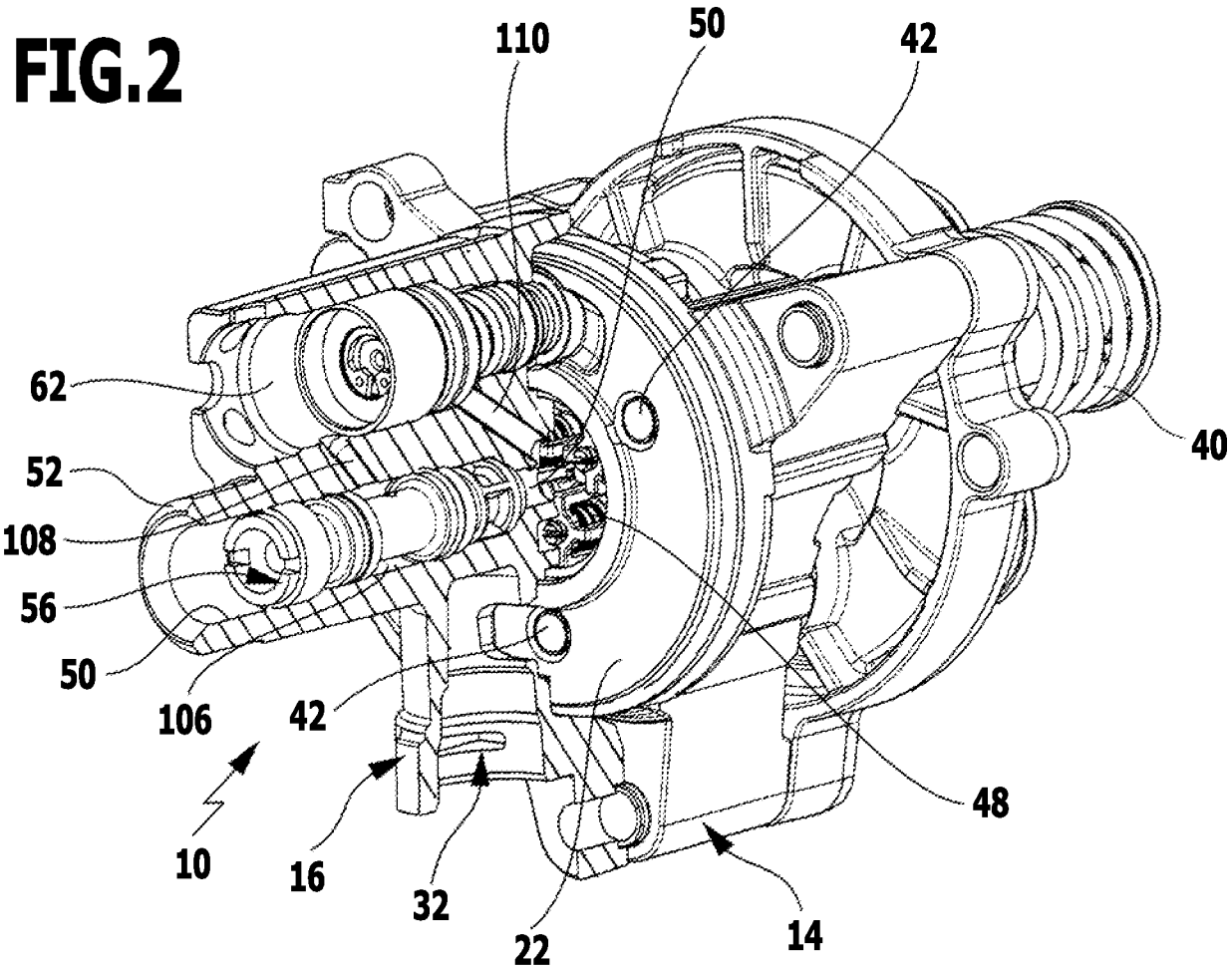
FIG. 2 is a perspective view, taken at an angle from the front, of the pump shown in FIG. 1, with the front housing part partly cut away.

By way of an inlet conduit 42 which is integrally formed in the rear housing part 14 and has an inlet valve 44 inserted therein, each pump chamber 34 is in flow communication with the ring-shaped outlet section 30 of the suction conduit. To this end, the inlet conduit 42 opens out into the front-end parting surface 22 of the rear housing part 14. This is shown in FIG. 2, for example.

By way of an outlet conduit 46 which is integrally formed in the rear housing part 14 and has an outlet valve 48 inserted therein, each pump chamber 34 is in flow communication with a pressure conduit 50 which runs in a longitudinal direction of the pump 10 and is integrally formed in the front housing part 16. To this end, the outlet conduit 46 opens out into the front-end parting surface 22 of the rear housing part and the pressure conduit 50 starts from the rear-end parting surface 20 of the front housing part 16 and extends up to an end face 52 of the front housing part 16 which faces away from the rear housing part 14. The end face 52 forms the front end of the pump 10. The area between the outlet conduits 46 of the pump chambers 34 and the pressure conduit 50 is sealed radially outward by the inner seal ring 26.

The pressure conduit 50 has a central pressure valve 54 arranged therein, and downstream of the pressure valve 54, the pressure conduit 50 accommodates a restriction element in the form of an injector 56. The latter comprises, in a customary manner, a through-bore 58 that first converges and then diverges in the direction of flow, a cross-bore 60 branching off at the narrowest location of the through-bore 58.

A through-channel 62 of stepped configuration running parallel to the pressure conduit 50 extends through the front housing part 16 from the end face 52 up to the rear-end parting surface 20. The face-end end region of the through-channel 62 accommodates a closure plug 64 that tightly closes the through-channel 62 at its end face. In the area following the closure plug 64, the through-channel 62 defines a control chamber 66 which is followed, via a step 68, by a lower section 70 of a bypass conduit, described in greater detail below. The lower section 70 accommodates a bypass valve 72 and opens out into the annular channel 28 and thus into the outlet section 30 of the suction conduit arranged in the joining area between the two housing parts 14, 16.

The control chamber 66 is of cylindrical configuration and accommodates a sliding sleeve 74 which contacts the wall of the control chamber 66 with a seal ring 76 interposed therebetween. A control member in the form of a control piston 78 is supported in the sliding sleeve 74 for displacement in a direction parallel to the longitudinal axis of the pressure conduit 50. The control piston 78 divides the control chamber 66 into a low-pressure chamber 80 that faces towards the closure plug 64 and a high-pressure chamber 82 that faces away from the closure plug 64 and is followed by the lower section 70 of the bypass conduit.

Figure 4:
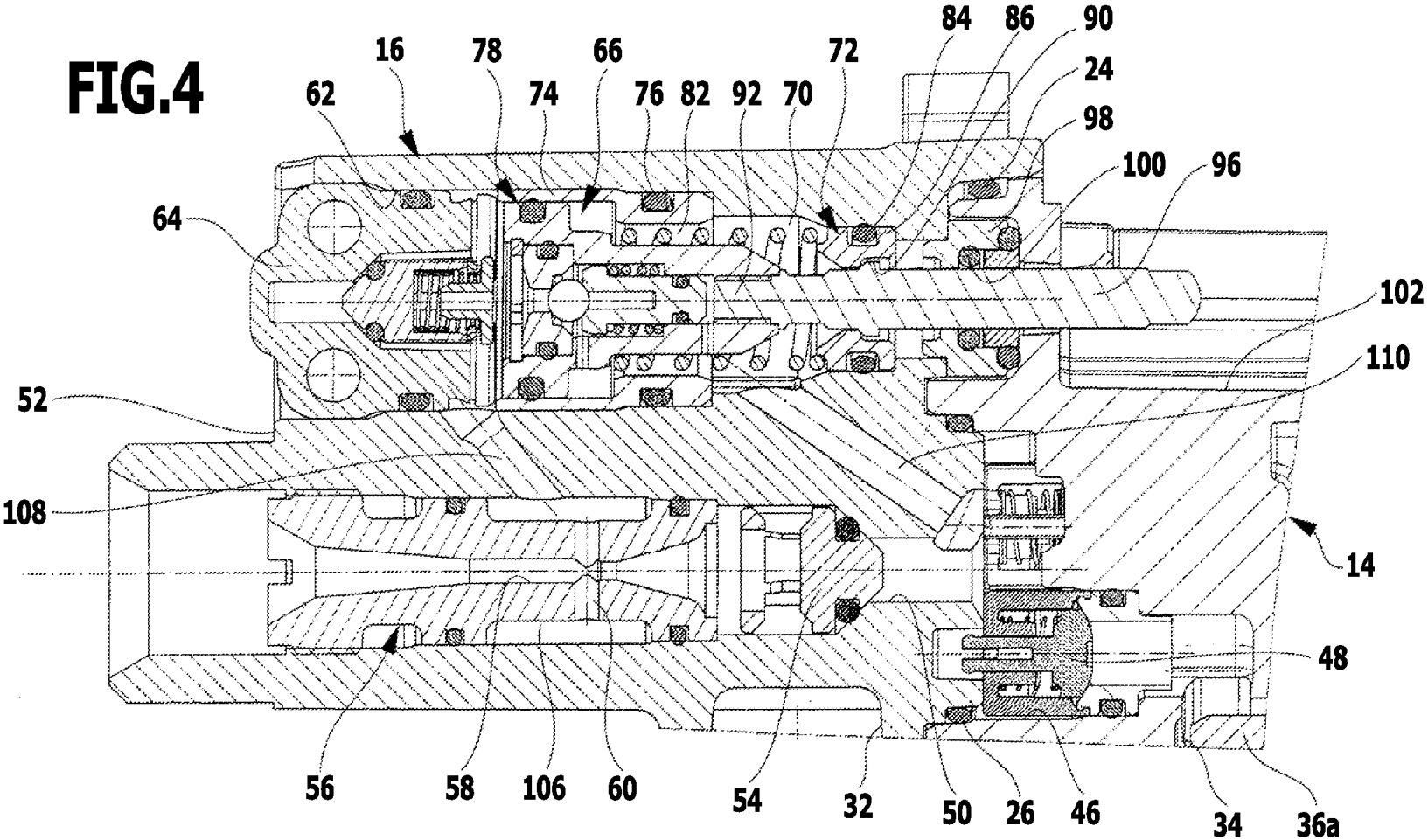
FIG. 4 is a partial sectional view of the pump of FIG. 1, taken in the area of a bypass valve, the valve body of which is in a closed position.
Figure 5:
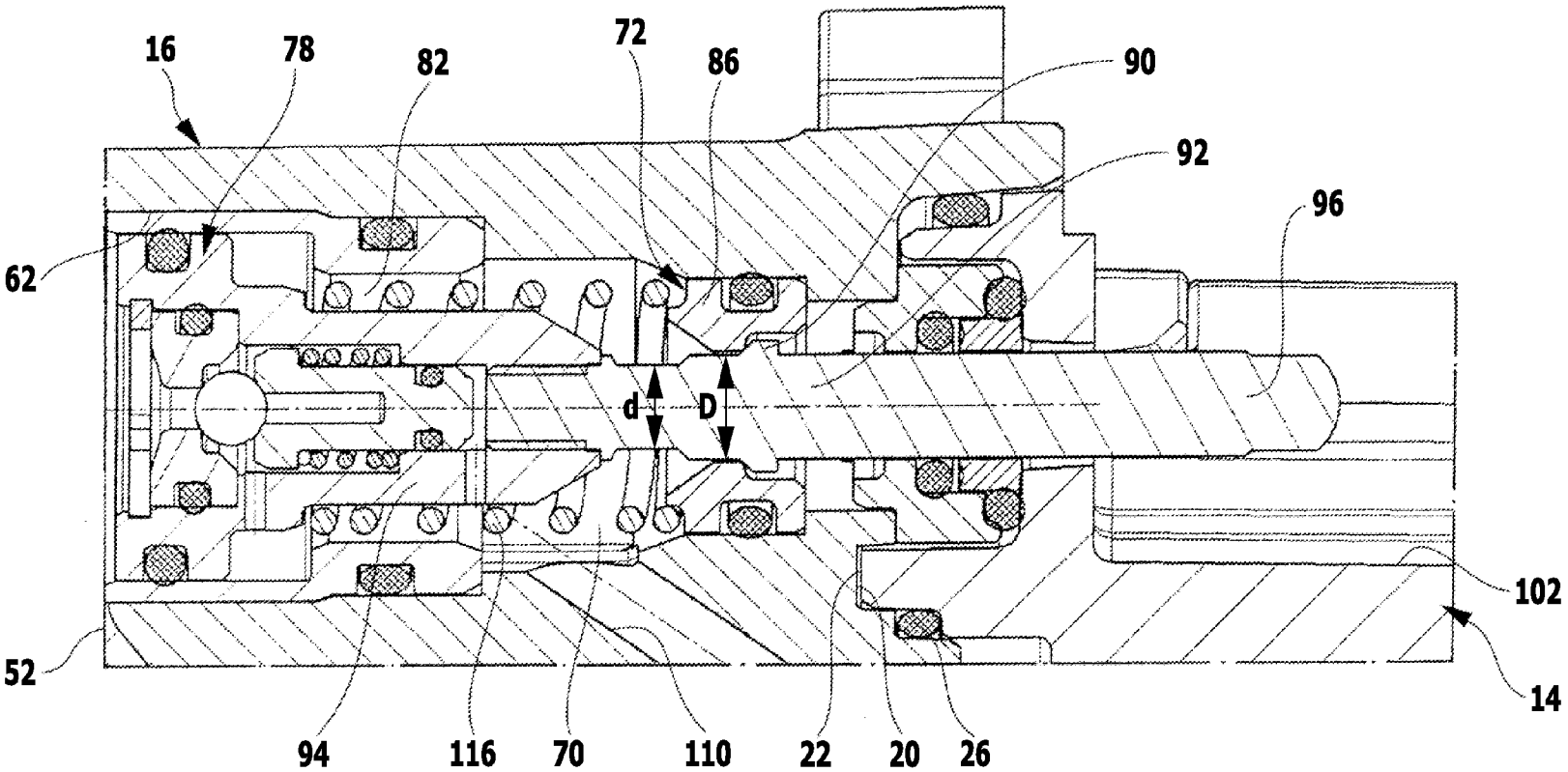
FIG. 5 is an enlarged partial sectional view of the pump of FIG. 1, taken in the area of the bypass valve, with the valve body in its closed position.

Inserted in the lower section 70 of the bypass conduit, with a seal ring 84 interposed therebetween, is a valve housing of the bypass valve 72 in the form of a valve sleeve 86 which surrounds a cylindrical valve opening 87 and forms a valve seat 88 of the bypass valve 72. A valve body 90 of the bypass valve 72 can sealingly contact the valve seat 88 in a closed position as shown in FIGS. 4 and 5. The valve body 90 is formed by a radial extension of a piston rod 92 which extends parallel to the longitudinal axis of the pressure conduit 50 and is connected at its end facing towards the closure plug 64 to a shaft 94 integrally formed on the control piston 78. The piston rod extends through the valve opening 87.

On the side of the valve body 90 that faces away from the shaft 94, the piston rod 92 forms a switch plunger 96 which is slidingly guided in a guide sleeve 98 with a seal ring 100 interposed therebetween. The guide sleeve 98 is arranged in the annular channel 28 of the rear-end parting surface 20 of the front housing part 16 so as to be aligned with and spaced apart from the valve housing 86 of the bypass valve 72.

Figure 1:
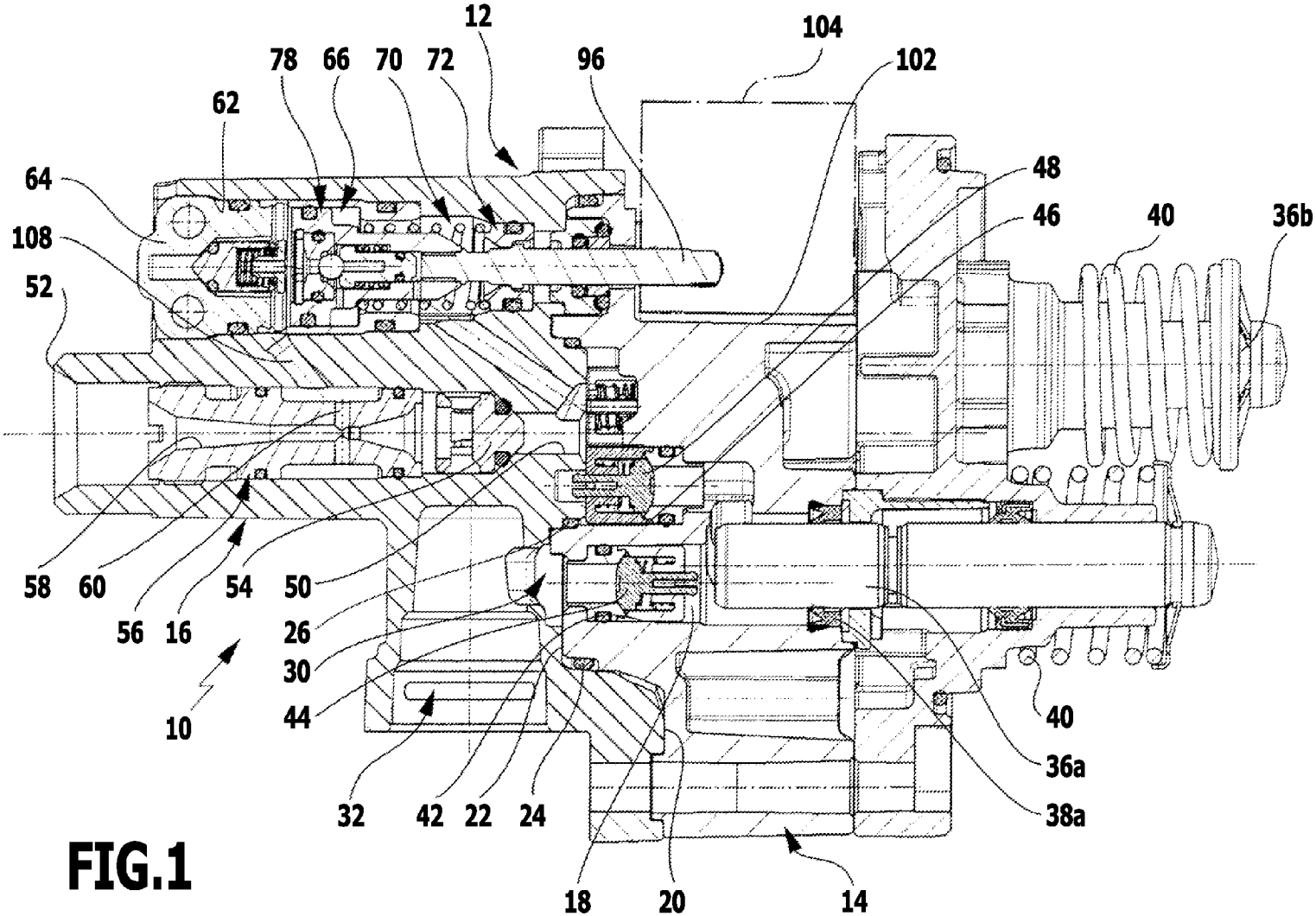
FIG. 1 is a longitudinal section of a pump in accordance with the invention.

The free end of the switch plunger 96 extends into a receiving space 102 which is integrally formed in the rear housing part 14 on a side thereof and which accommodates a switch element 104, known per se and shown by the dash-dot-line in FIG. 1, which can be actuated by the switch plunger 96. The switch plunger extends through the joining area between the two housing parts 14 and 16.

On its outer side, the injector 56 arranged in the pressure conduit 50 has an annular groove 106 into which the cross-bore 60 opens out. The annular groove 106 is followed by a control conduit 108 via which the annular groove 106 is in flow communication with the low-pressure chamber 80.

Upstream of the injector 56 and the central pressure valve 54, an upper section 110 of the bypass conduit extends from the pressure conduit 50 to the high-pressure chamber 82. The upper section 110 is followed in the through-channel 62 by the lower section 70 of the bypass conduit, which has already been mentioned. The bypass conduit, formed by the two sections 70 and 110, defines a flow communication between the pressure conduit 50 and the outlet section 30 of the suction conduit. This flow communication can be opened and shut as a function of the position of the valve body 90 of the bypass valve 72.

As is shown in FIG. 3 in particular, the annular channel 28 and with it the outlet section 30 of the suction conduit surround both the pressure conduit 50 and all the outlet conduits 46 of the individual pump chambers 34 in a circumferential direction. A high-pressure section of the joining area between the two housing parts 14 and 16 which is arranged at a radially centred position is thus surrounded by the annular channel and is sealed against the annular channel by the inner seal ring 26. The inner seal ring 26 separates the radially centred high-pressure section of the joining area from a ring-shaped low-pressure section of the joining area. The low-pressure section surrounds the high-pressure section. It is configured in the form of the annular channel 28 and sealed radially outside by the outer seal ring 24.

By way of the inlet section 32 and the outlet section 30 of the suction conduit and the inlet conduits 42 following the outlet section 30 in the joining area, the pump chambers 34 can be supplied with cleaning liquid to be pumped. Within the pump chambers 34, the cleaning liquid is pressurized as a result of the oscillatory motion of the pistons, and the liquid under pressure is supplied to the pressure conduit 50 via the outlet conduits 46.

During normal operation of the pump 10, the cleaning liquid under pressure flows through the injector 56. The latter forms a restriction in the pressure conduit 50 where the cleaning liquid flowing therethrough suffers a pressure reduction, so that the region of the pressure conduit 50 located upstream of the injector 56 has a higher pressure than the region of the pressure conduit located at a level of the cross-bore 60 of the injector 56. As long as there is a flow of cleaning liquid through the pressure conduit 50, the pressure applied to the low-pressure chamber 80, which is connected via the control conduit 108 to the cross-bore 60, is lower than that applied to the high-pressure chamber 82, which is connected via the upper section 110 of the bypass conduit to the inlet area of the pressure conduit 50. As a result, the control piston 78 is displaced in the direction of the closure plug 64, so that the valve body 90 of the bypass valve 72 is in tight contact with the valve seat 88, thereby interrupting the flow communication between the pressure conduit 50 and the outlet section 30 of the suction conduit. The movement of the control piston 78 in the direction of the closure plug 64 is assisted by a compression spring 116 which surrounds the shaft 94 and on the one hand contacts the control piston 78 and on the other the valve sleeve 86.

When the flow of the cleaning liquid through the pressure conduit 50 is interrupted, for example by closing a nozzle head that is connected via a pressure hose to the pressure conduit 50, then no dynamic pressure reduction occurs in the area of the restriction of the injector 56; instead, the pressure in this area is equal to the pressure existing upstream of the pressure valve 54. In this case, equal pressures occur in the low-pressure chamber 80 and the high-pressure chamber 82, and, with appropriate dimensioning of the effective areas exposed to pressure of the control piston 78, the latter is thereby displaced against the action of the compression spring 116 in the direction facing away from the closure plug 64. As a result, the valve body 90 unseats from the valve seat 88, so that the bypass valve 72 opens the flow communication from the pressure conduit 50 via the sections 70 and 110 of the bypass conduit to the outlet section 30 of the suction conduit. This makes it possible to reduce the pressure existing in the pressure conduit 50.

The movement of the control piston 78 and of the piston rod 92 connected thereto also results in the switch element 104 being actuated via the switch plunger 96. This allows the drive of the pump 10 to be switched off. Unnecessary operation of the drive while the nozzle head is closed is thereby avoided.

As has already been mentioned, the valve body 90 of the bypass valve 72 is configured in the form of a radial extension of the piston rod 92. Facing towards the valve seat 88, the valve body 90 forms a frustoconical sloping surface 118 with which it tightly contacts the valve seat 88 when the bypass valve 72 is in the closed position. This is shown in FIGS. 4 and 5 in particular.

Figure 6:
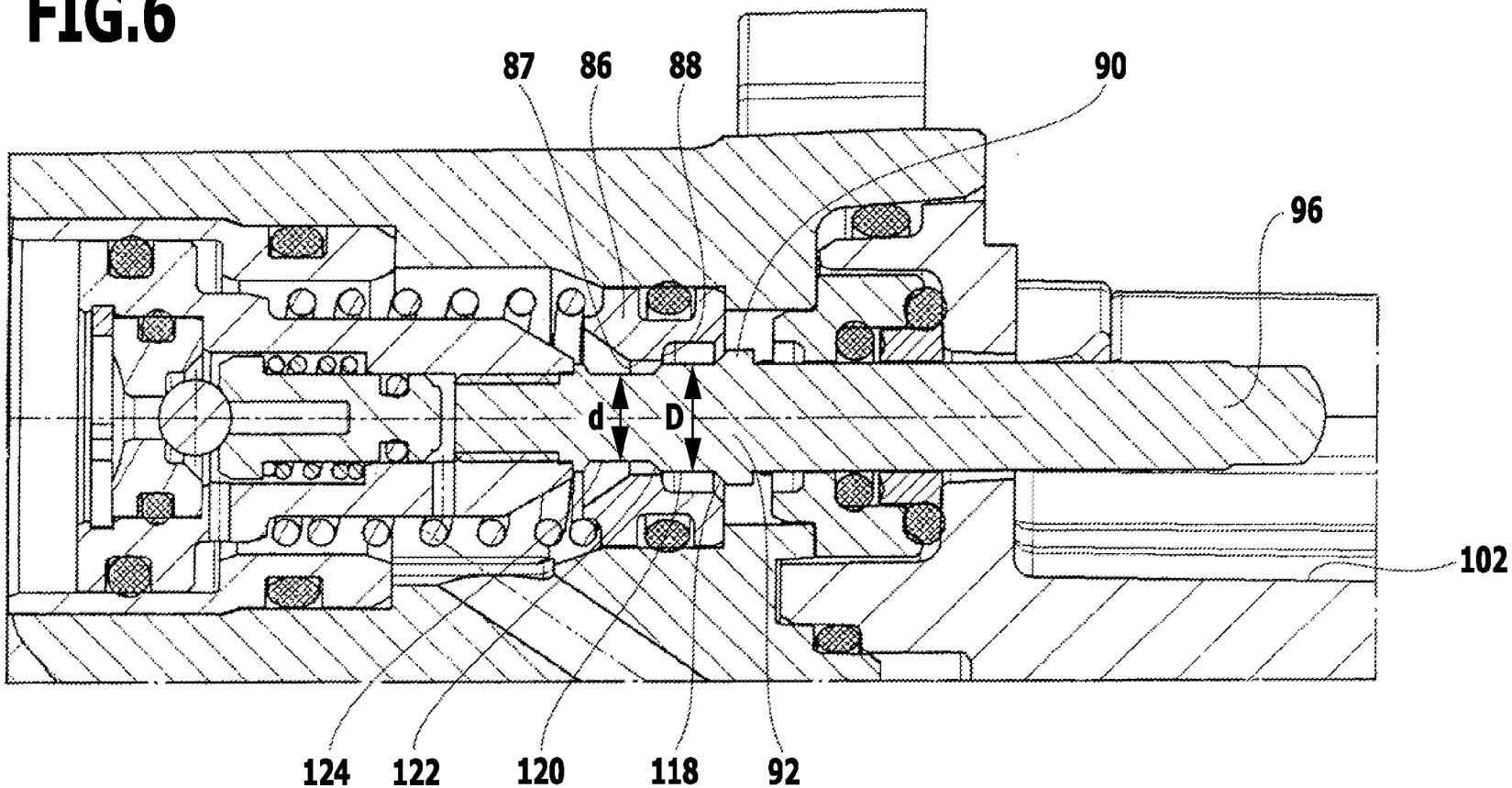
FIG. 6 is an enlarged partial sectional view of the pump corresponding to FIG. 5, wherein the valve body has travelled a first partial distance of its stroke movement from its closed position to its open position.
Figure 7:
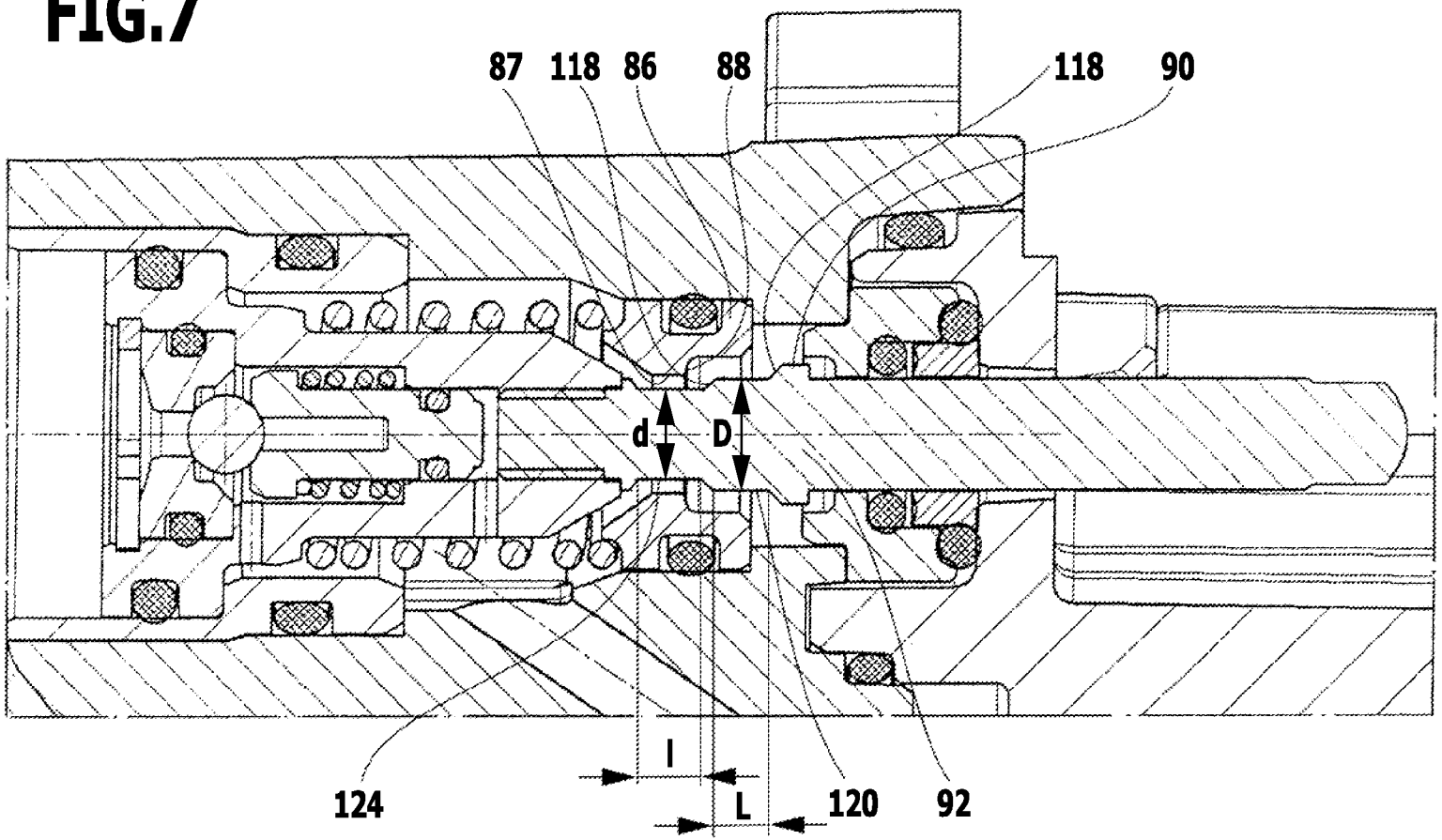
FIG. 7 is an enlarged partial sectional view of the pump corresponding to FIG. 5, wherein the valve body is in its open position.

Upstream of the sloping surface 118, the valve body 90 is followed by a first cylindrical section 120 of the piston rod 92 which extends in the direction of the control piston 78 at a constant outer diameter D along an axial length L of the piston rod 92. The first cylindrical section 120 is followed in the direction of the control piston 78, via a conical restriction 122, by a second cylindrical section 124 of the piston rod 92. The second cylindrical section 124 extends in the direction of the control piston 78 at a constant outer diameter d along an axial length l of the piston rod 92. This is shown in FIGS. 5, 6 and 7 in particular. The diameter D of the first cylindrical section 120 is selected to be only slightly smaller than the diameter of the cylindrical valve opening 87 of the bypass valve 72, whereas the diameter d of the second cylindrical section 124 is selected to be significantly smaller. For example, the diameter d of the second cylindrical section may be less than 80%, in particular approximately 75%, of the diameter of the cylindrical valve opening 87, while the diameter D of the first cylindrical section 120 is more than 90%, in particular approximately 95%, of the diameter of the cylindrical valve opening 87.

As the valve body 90 transitions from the closed position depicted in FIGS. 4 and 5 to the open position shown in FIG. 7, the valve body opens a passage through which cleaning liquid can flow. The passage is defined by the annular gap between the cylindrical valve opening 87 and the outer diameter of the piston rod 92. When the valve body 90 unseats from the valve seat 88, first the first cylindrical section 120 assumes a position within the valve opening 87, so that a very narrow annular gap forms between the first cylindrical section 120 and the cylindrical valve opening 87, said annular gap being available as a passage for the cleaning liquid. It is only after the valve body 90 is at a predetermined distance from the valve seat 88, which is determined by the length L of the first cylindrical section 120, that the passage which is available for the cleaning liquid is increased, it now being the second cylindrical section 124 that assumes a position in the cylindrical valve opening 87, thereby opening a considerably larger annular gap. The flow cross-section of the passage opened by the valve body 90 as the latter unseats from the valve seat 88 thus becomes wider after the valve body 90 has overcome a first partial distance in the form of the axial length L of the first cylindrical section 120. No further increase of the flow cross-section takes place in the second cylindrical section 124, as the stroke movement of the valve body 90 is continued.

When the valve body 90 unseats from the valve seat 88, the amount of cleaning liquid that can initially flow through the bypass valve 72 per unit time is only relatively small. Thus, the cleaning liquid flowing through the bypass valve 72 initially experiences a constant, high resistance to flow when the valve body 90 unseats from the valve seat 88, and a considerable pressure drop occurs at the piston rod 92 in the area of the bypass valve 72. As a result, the control piston 78 and the piston rod 92 are displaced in the direction facing away from the closure plug 64, so that the switch plunger 96 formed by the free end region of the piston rod 92 is reliably displaced into the receiving space 102. This ensures that the switch element 104, which is arranged in the receiving space 102, can be actuated in order to switch off the pump 10.

It is only after the valve body 90 has been displaced towards its open position far enough for the second cylindrical section 124 to assume a position within the valve opening 87 that the flow resistance of the cleaning liquid and with it also the pressure drop at the piston rod 92 is reduced. The recirculation of cleaning liquid from the pressure conduit 50 via the sections 70 and 110 of the bypass conduit to the outlet section 30 of the suction conduit can now take place with low losses of flow. Should the pump have failed to have been switched off before this as a result of the switch element 104 being incorrectly positioned or as a result of the switch element 104 being defective, then the continued running of the pump in recirculation mode can now take place with very low pressure losses. This is advantageous in that only a relatively low pressure develops within the pump 10 in recirculation mode, for example a pressure no greater than 10 bar, so that only low thermal losses and low mechanical loading of the pump 10 occur in recirculation mode.

The recirculation mode operation is terminated by re-opening the nozzle head, since this allows cleaning liquid to be discharged via the nozzle head, so that a flow of liquid develops in the injector 56 and, owing to the restricting effect of the injector 56, a pressure reduction takes place in the low-pressure chamber 80. As a consequence, the control piston 78, under the effect of the pressure conditions and under the action of the compression spring 116, is re-displaced in the direction facing towards the closure plug far enough for the valve body 90 to assume its closed position, in which it contacts the valve seat 88. Furthermore, the displacement of the control piston 78 also displaces the switch plunger 96 in the direction facing towards the closure plug 64, so that the drive of the pump 10 can be turned on again by the switch element 104.

The invention claimed is:

1. Pump for a high-pressure cleaning apparatus for delivering a cleaning liquid, said pump comprising at least one pump chamber into which at least one reciprocally movable piston plunges and which is connected via at least one inlet valve to a suction conduit and is connected via at least one outlet valve to a pressure conduit, and a bypass conduit leading from the pressure conduit to the suction conduit and having arranged therein a bypass valve, a valve body of which is connected, via a piston rod, to a control member which displaces the valve body as a function of a flow rate of the cleaning liquid in the pressure conduit to a closed position or an open position and displaces a switch plunger which is coupled to the valve body to a first or a second switch position to actuate a switch element, wherein the valve body, as it transitions from its closed position to its open position, opens a passage upstream of a valve seat permitting cleaning liquid to flow therethrough, the passage having a first constant flow cross-section along a first partial distance of a stroke movement of the valve body, the flow cross-section of said passage becoming wider than the first constant flow cross-section when the valve body is at a predetermined distance from the valve seat.

2. Pump in accordance with claim 1, wherein the passage has a second constant flow cross-section along a second partial distance of the stroke movement of the valve body following the first partial distance, said second flow cross-section being larger than the first flow cross-section.

3. Pump in accordance with claim 1, wherein the valve body is configured as a radial extension of the piston rod, wherein the piston rod extends through a valve housing of the bypass valve, wherein the valve housing forms the valve seat, and wherein a diameter of the piston rod is constricted upstream of the valve body at a predetermined distance therefrom.

4. Pump in accordance with claim 3, wherein the piston rod has a first cylindrical section of constant diameter following the valve body in an upstream direction.

5. Pump in accordance with claim 4, wherein the piston rod has a second cylindrical section of constant diameter in a direction upstream of the first cylindrical section, wherein the diameter of the second cylindrical section is smaller than the diameter of the first cylindrical section.

6. Pump in accordance with claim 1, wherein the switch plunger is configured as an axial extension of the piston rod.

7. Pump in accordance with claim 1, wherein the pump has a rear housing part and a front housing part, which are tightly joined together in a joining area, wherein a suction conduit section extends in the joining area between the two housing parts and the bypass conduit opens out into the suction conduit section.

8. Pump in accordance with claim 7, wherein the suction conduit section is configured as a self-contained ring.

9. Pump in accordance with claim 7, wherein the control member is configured as a control piston which divides a control chamber of the front housing part into a low-pressure chamber and a high-pressure chamber, is displaceable in the control chamber, and is connected to the valve body of the bypass valve via the piston rod, wherein the low-pressure chamber is connected to the pressure conduit via a control conduit downstream of a restriction and the high-pressure chamber is connected to the pressure conduit via a section of the bypass conduit arranged upstream of the bypass valve.

10. Pump in accordance with claim 9, wherein the bypass conduit includes a section accommodating the bypass valve, said section opening out into the suction conduit section arranged in the joining area between the two housing parts, and being aligned with the control chamber.

11. Pump in accordance with claim 10, wherein the control chamber and the section of the bypass conduit accommodating the bypass valve are oriented parallel to the pressure conduit.

12. Pump in accordance with claim 10, wherein the control chamber and the section of the bypass conduit accommodating the bypass valve are arranged in a through-channel which extends through the front housing part from an end face to a rear-end parting surface.

* * * * *